United States Patent [19]

Lindeman

[11] Patent Number: 4,806,110

[45] Date of Patent: Feb. 21, 1989

[54] ELECTRICAL CONNECTORS

[75] Inventor: Richard J. Lindeman, Wood Dale, Ill.

[73] Assignee: Labinal Components and Systems, Inc., Elk Grove Village, Ill.

[21] Appl. No.: 947,317

[22] Filed: Dec. 29, 1986

Related U.S. Application Data

[63] Continuation-in-part of Ser. No. 876,179, Jun. 19, 1986, Pat. No. 4,710,133.

[51] Int. Cl.[4] ..... H01A 4/66

[52] U.S. Cl. ..... 439/108; 439/65; 439/637

[58] Field of Search ..... 439/60–65, 439/95, 108, 109, 606, 637, 581, 680

[56] References Cited

U.S. PATENT DOCUMENTS

| | | | |
|---|---|---|---|
| 3,334,325 | 8/1967 | Conrad et al. | 439/60 |
| 4,645,278 | 2/1987 | Yevak, Jr. et al. . | |
| 4,655,518 | 4/1987 | Johnson et al. . | |
| 4,659,155 | 8/1987 | Walkup et al. | 439/60 X |
| 4,686,607 | 8/1987 | Johnson . | |

OTHER PUBLICATIONS

High-Density Printed Circuit Connector, Callaway et al., IBM Tech. Discl. Bull. vol. 8, No. 3, Aug. 1965, p. 351–352.

Teradyne Technical Bulletin 237, p. 8, with 339–17.LC and 1–29–85 noted on it.

*Primary Examiner*—Eugene F. Desmond

*Attorney, Agent, or Firm*—Neuman, Williams, Anderson & Olson

[57] ABSTRACT

This invention relates to electrical connectors and more particularly to electric connectors for propagation of a relatively large number of signals between electrical circuits and at very high velocities. The number of signals which can be propagated is quite large in relation to the size of the connectors of the invention and at the same time, the signals can be transmitted at very high velocity and with minimal interference between the signals propagated or from external signal sources. The connectors are also advantageous in that the electrical characteristics of the propagation paths are uniform and they can be readily matched to the characteristics of the circuits which are interconnected so as to minimize standing wave phenomena. The invention also facilitates connection to a plurality of circuit board circuits while providing substantially complete separation of signals propagated to and from the circuits.

16 Claims, 4 Drawing Sheets

12

12
22
21
34
32
33
31
22b 14
46
44b
33a
44
45
44a
31a 42b
42
42a 18a
18

ELECTRICAL CONNECTORS

This application is a continuation-in-part of my copending application Ser. No. 876,179, filed June 19, 1986, now U.S. Pat. No. 4,710,133 issued Dec. 1, 1987.

This invention relates to electrical connectors and more particularly to electrical connectors which are usable for propagation of a relatively large number of signals between electrical circuits and at very high velocities and which are also usable to transmit supply and/or other voltages between such electrical circuits. The number of signals which can be propagated is quite large in relation to the size of the connectors of the invention and at the same time, the signals can be transmitted at very high velocity and with minimal interference between the signals propagated or from external signal sources. The connectors are also advantageous in that the electrical characteristics of the propagation paths are uniform and they can be readily matched to the characteristics of the circuits which are interconnected so as to minimize standing wave phenomena. The invention also facilitates connection to a plurality of circuit boards while providing substantially complete separation of signals propagated to and from their circuits and while also providing connection between such circuits for transmission of supply and/or other voltages there between.

BACKGROUND OF THE INVENTION

Conventional types of connectors have been used heretofore for connection of circuits of mother boards and daughter boards, in computer equipment or in similar applications, and they have generally been highly reliable in operation. However, there have been problems and in the last few years they have been of increasing magnitude, especially when contact spacings are reduced to reduce the sizes of connectors and/or to increase the number of contacts or when the interconnected circuits are designed to use advances in technology which make it possible to transmit large volumes of data at high speeds. Such problems have included loss of transmitted signals, interference between signals or "cross-talk" and interference from extraneous signals. The existence of such increasing problems have been generally recognized but satisfactory solutions have not been apparent.

SUMMARY OF THE INVENTION

This invention was evolved with the general object of providing electrical connectors which will reliably propagate large numbers of signals between circuits at very high velocities while at the same time being of relatively small size and being readily and economically manufactured.

A specific object of the invention is to provide connectors which are also operable to transmit supply, reference or control voltages without interference with the propagation of high velocity signals and without increasing the size of the connector or cost of manufacture thereof.

As hereinafter discussed, the connectors of my aforementioned prior application are usable advantageously to transmit supply, reference or control voltages. A connector is disclosed in this application which provides additional capabilities and advantages with respect to transmission of such voltages, while retaining all of the features and advantages of the invention as previously disclosed.

As disclosed in my aforementioned prior application, important aspects of the invention relate to the discovery and recognition of problems with prior connector constructions. It has been found that ground connections tend to develop electrostatic charges when attempts are made to propagate high volumes of pulse signals at very high speeds as when employing VHSIC or very high speed integrated circuits. A shift in voltage between ground planes of two interconnected circuits may result in loss of reference levels in electronic circuitry, thus rendering computers and the like inoperative. Mismatched impedances between circuitry and connectors causes reflections and the production of undesirable standing wave phenomena, with corresponding errors in transmitting data, in the case of transmitting digital signals. It is also found that cross talk between signal paths increases with frequency and with decreases in the spacing therebetween. This problem is affected to a substantial extent by the characteristics of the ground connection which is common to the two signal propagation paths. Inductive reactances for a given path length increase with frequency and if the ground connection has a substantial reactance, it can cause problems with high frequency signal propagation or high velocity pulse signal propagation. This fact has not been generally recognized because the ground paths of conventional connectors have inductive reactances which have not produced a problem when transmitting signals at relatively low frequencies.

Typically, one or more connector pins have been used in the past for ground connections and, in some cases, each pin used for signal transmission may have an associated adjacent pin used for a ground connection, in an attempt to minimize cross talk problems. It is found that this does not provide an adequate solution because there may nevertheless be substantial impedances in the ground connections and also, this solution requires many more connector pins. Moreover, if the number of ground pins were increased so as to use two or more pins for each signal pin, it would impose severe space limitations as well as increasing insertion forces.

Another problem with prior constructions relates to the impedance characteristics of the signal paths. Each signal path of an electrical connector may be considered as an electrical transmission line having a certain characteristic impedance determined by its resistance, inductance, and distributed capacitance per unit length. At relatively low signal transmission velocities, the actual impedance of the path is not usually important. However, at high velocities, the path may produce reflections, resonances and standing wave phenomena when there is a substantial mismatch between the characteristic impedance of the path and the characteristic impedances of the circuits connected thereto. It is also to be observed that it is especially desirable that the characteristic impedances of all paths be substantially the same, so as to facilitate design of the connected circuits.

An electrical connector assembly constructed in accordance with the invention may include a pair of mating connectors, each including a plurality of contact elements and each having at least one ground plate with electrically insulating material supporting the contact elements and each ground plate within an outer shell. In an embodiment of the invention as disclosed in my aforementioned prior application, there are two longitudinally spaced ground plates in each connector. Such ground plates need not be directly connected together electrically to each other or to the outer shell and they may be used with each other and/or with the outer shell for transmission of DC supply voltages, reference voltages or on-off control voltages or for other purposes. It is desirable, however, that there be a very low AC impedance between each ground plate and each other ground plate and between each ground plate and the outer shell so as to effectively provide a single ground for high velocity signal transmission.

Each ground plate of each connector has means along one edge thereof for connection to a mating edge portion of a mating ground plate of the other connector, opposite edges of the mating ground plates being arranged for connection to circuit means. For example, one connector may be mounted in a mother board and the other connector may be mounted in a daughter board with each ground plate being connected to a ground terminal of a circuit board of the daughter board. In an illustrated embodiment of the invention, the daughter board includes two circuit boards with ground terminals in facing relation engaged with connector means of a ground plate of the daughter board connector.

In an embodiment of the invention as illustrated herein, each of a pair of mating connectors includes two longitudinally spaced sections and each such section includes several ground plates in longitudinally spaced relation but with a close spacing in a longitudinal direction between adjacent edges thereof, such ground plates being operable to provide in effect a single continuous ground plate in spaced relation to the contact elements used for transmission of high velocity signals. At the same time, such ground plates of each section may be used advantageously for a variety of purposes including transmission of DC supply voltages, e.g. 5 volt and plus and minus 12 volt supply voltages. They may also or alternatively be used for transmission of reference or control voltages. It is not necessary to use contact elements for transmission of such voltages. All of contact elements are usable for transmission of high velocity signals and all of the features and advantages disclosed in my aforesaid prior application are obtained.

In particular, in all embodiments of the invention, the contact elements of each connector may include a group of elements which are associated with each ground plate and which are supported in a row in longitudinally spaced parallel relation in a first plane with the associated ground plate being supported in a second plane parallel to the first plane and extending longitudinally for substantially the full length of the row of contact elements associated therewith. With this arrangement, a sheet ground is provided of very low inductance and resistance which provides a very low impedance and which prevents the build-up of any potential difference between the interconnected circuits. The result is a very substantial increase in the speed and volume of data transmission which can be accommodated in a connector of a given size. The arrangement also minimizes ground path impedances and cross-talk effects between adjacent signal paths.

Each ground plate may be disposed between separate groups of contact elements which are respectively connected to separate circuit means such as circuits on the opposite side of a printed circuit board or on opposite faces of a pair of separate circuit boards. With this feature, it is possible to obtain substantially complete isolation which is a most important consideration in a great many applications.

As also disclosed in my aforesaid prior application, additional important features relate to the attainment of uniform characteristic impedance. The contact elements of each row are preferably at the same distance from the adjacent surface of the ground plate associated therewith. A second row of contact elements may be provided at a greater distance from the ground plate and at a closer distance to the wall of a shell, the distance from the second row to the shell being equal to the distance from the first row to the ground plate with the result being that all contact elements have substantially the same impedance characteristics when the shell and ground planes are electrically connected. In this arrangement, the contact elements may be arranged in staggered relationship and the overall result is a much higher contact density while at the same time minimizing cross-talk. By minimizing the length of signal paths and the distance between the ground plane and the outer shell which surrounds the signal paths, this construction reduces interference from extraneous signals as well as increasing the velocity of signal propagation through the connector.

This invention contemplates other objects, features and advantages which will become more fully apparent from the following detailed description taken in conjunction with the accompanying drawings.

DESCRIPTION OF A PREFERRED EMBODIMENT

Figure 1:
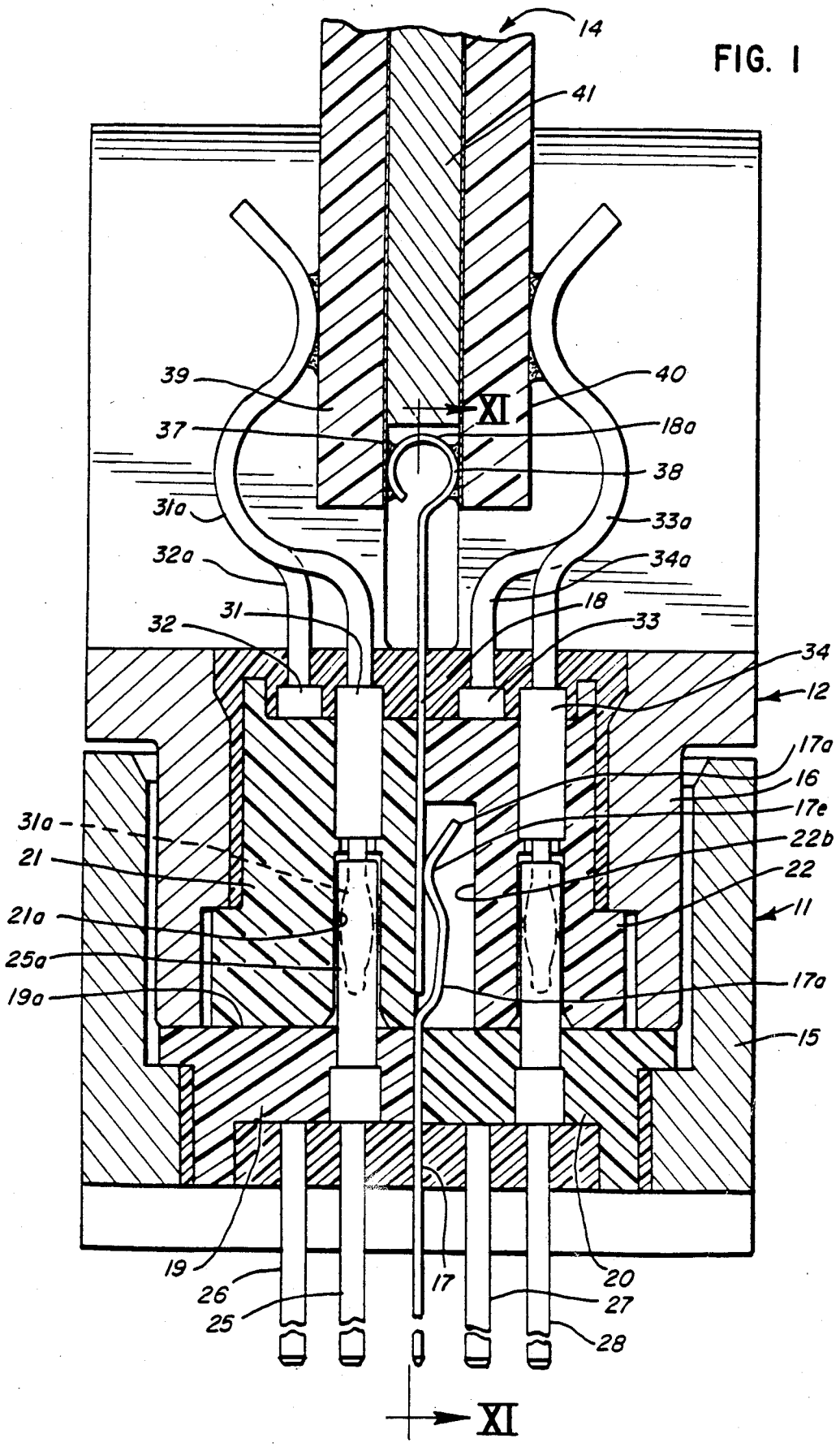
FIG. 1 is a transverse sectional view of a pair of mated connectors constructed in accordance with the principals of this invention, the lower connector of FIG. 1 being a receptacle and the upper connector being a plug and being shown connected to a circuit board assembly.

Reference numeral 10 generally designates a connector assembly constructed in accordance with the principles of this invention. The illustrated assembly 10 includes mating connectors 11 and 12. The connector 11, as shown, is adapted to be mounted on and form part of a mother board and the connector 12 is adapted to receive and to be secured to a circuit board assembly 14 to form a daughter board. It will be understood that the connectors 11 and 12, and the novel features thereof which form part of the invention, may be used in other configurations and for other purposes.

The connector 11 as shown includes an outer shell 15 which receives an outer shell 16 of the connector 12, the connector 11 being thus in the form of a receptacle and the connector 12 being thus in the form of a plug. It will be understood, of course, that the invention is not limited to this relationship and, for example, the connector 11 might be in the form of a plug while the connector 12 might be in the form of a receptacle. Shells 15 and 16 are preferably of a highly conductive metal such as aluminum and are preferably connected electrically to each other and to electrical grounds of the interconnected circuits.

In accordance with the invention, the connectors 11 and 12 include central plates which are generally designated by reference numerals 17 and 18 and connected to the electrical grounds of interconnected circuits plates 17 and 18 together define a central planar ground extending along the length of the connector, in a direction normal to the plane of the paper in FIG. 1. As hereinafter discussed in connection with FIG. 11, each of the plates 17 and 18 may be in the form of a plurality of separate plate sections usable for transmission of DC supply or other voltages but with a low AC impedance between such separate plates, they provide a very low impedance ground connection and act as an electrical separation and shield between contacts on opposite sides thereof. Plate 17 is sandwiched between a pair of members 19 and 20 of insulating material which are secured in the shell 15 of connector 11 and plate 18 is sandwiched between a pair of members 21 and 22 of insulating material which are secured within the shell 16 of connector 12.

In the illustrated embodiment, the connector 11 includes contacts in four groups, contacts 25 of the first group being located relatively close to the ground plate 17 and being supported by the member 19, contacts 26 being spaced further from the ground plate 17 and being also supported by the member 19, contacts 27 being supported by the member 20 on the opposite side of the ground plate and relatively close to the ground plate 17 and contacts 28, also supported by the member 20 and being spaced further away from the ground plate 17.

Figure 2:
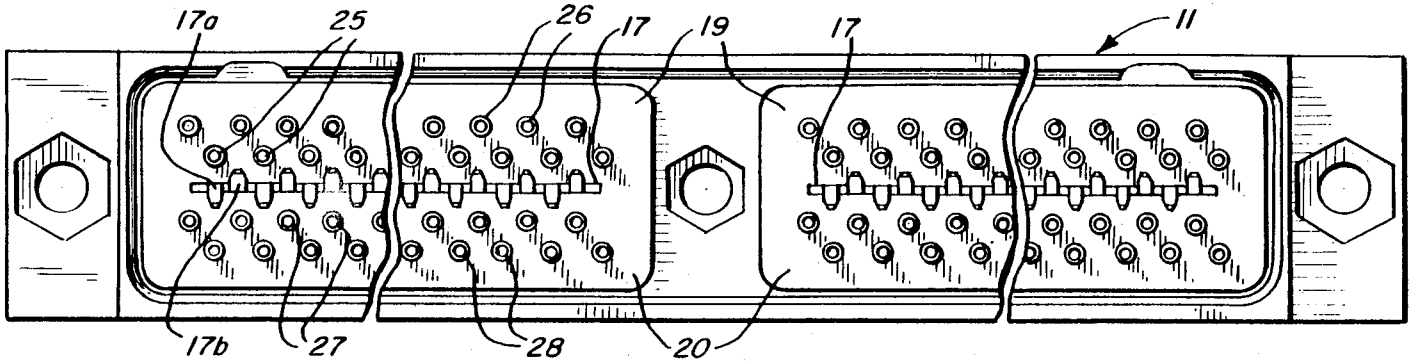
FIG. 2 is a plan view of the receptacle connector of FIG. 1, on a reduced scale and with intermediate portions broken away.
Figure 3:
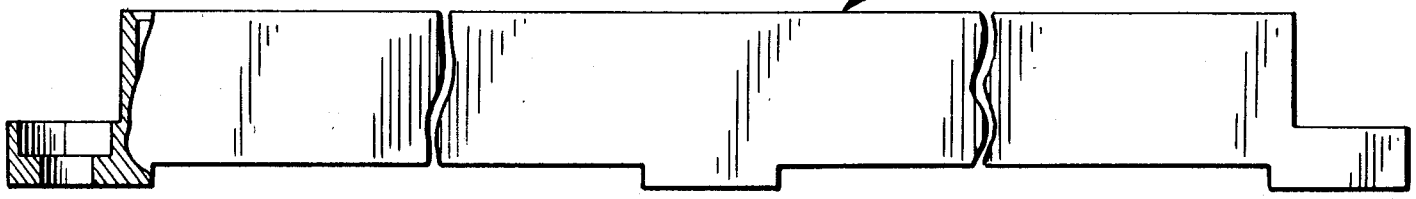
FIG. 3 is a side elevational view of the receptacle connector of FIG. 2.

As shown in FIG. 2, the contacts 25 and 26 are in staggered relationship to each other and the contacts 27 and 28 are similarly in staggered relation to each other. As also shown in FIG. 2, the shell 11 may have an intermediate wall portion 29, separating the connector into two sections with there being two longitudinally spaced ground plates 17 and associated groups of contacts 25–28. Each of such plates 17 and each of the two mating plates 18 may be in the form of a plurality of separate plate sections, as hereinafter discussed in connection with FIG. 11.

Each connector may have a large number of contacts and, by way of example, each section may have 120 contacts with a total of 240 contacts for the two sections, the spacing of contacts as indicated by reference numeral 30 in FIG. 2 being typically 0.075 inches and the overall length of the connector being on the order of 5 inches. With a contact spacing of 0.05 inches, a total of 352 contacts may be provided. It should be understood, of course, that the connectors need not be separated into two sections as illustrated in FIG. 2 and, of course, any appropriate contact spacing may be used. It is, however, an important feature of the invention that a relatively large number of contacts may be provided in a compact connector with relatively close spacing of contacts, while avoiding the problems which would be encountered with such contact spacings when using prior art constructions.

Figures 6, 7, 8, 9, 10:
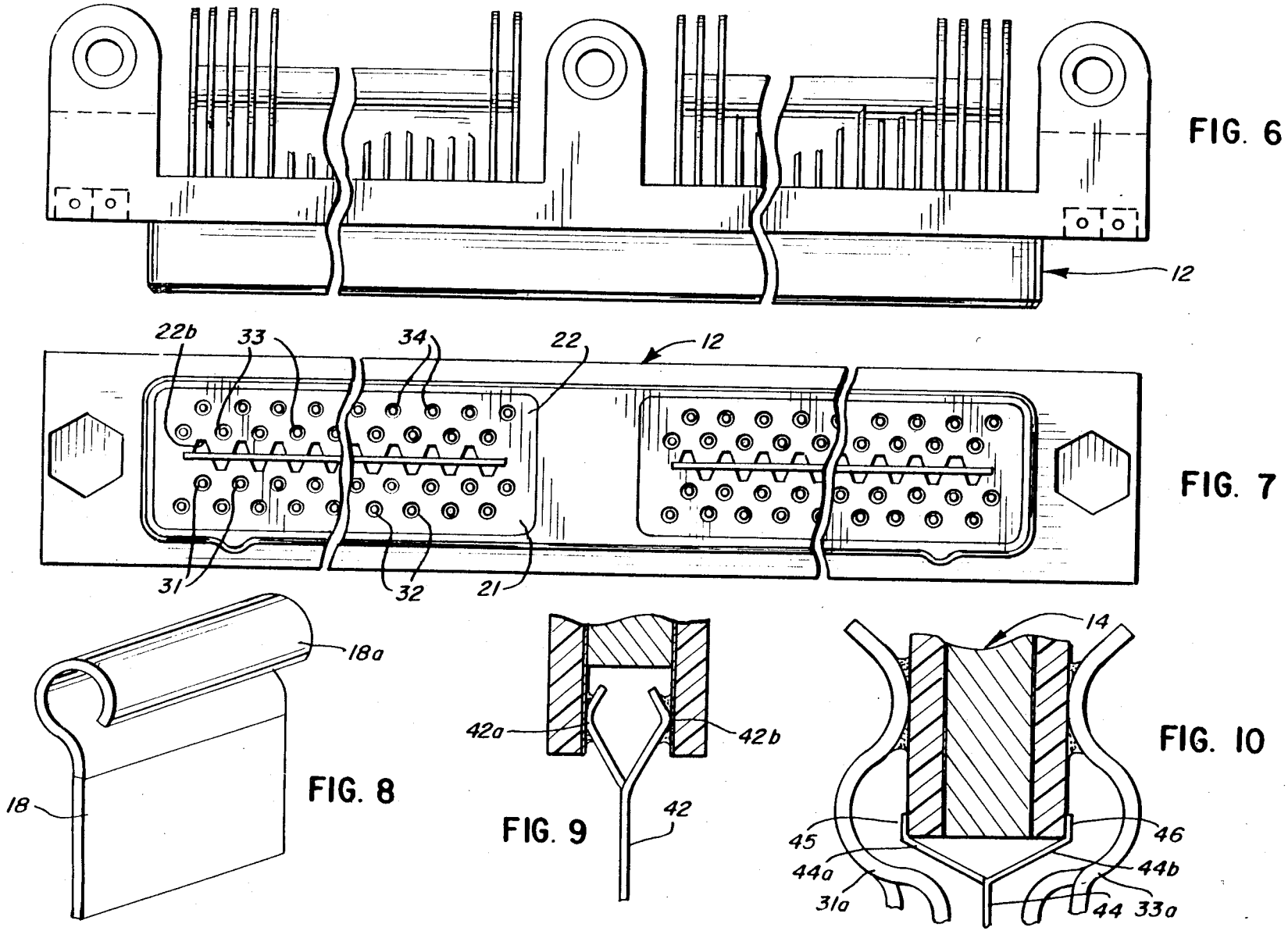
FIG. 6 is a side elevational view of the plug connector of FIG. 1 but on a reduced scale.
FIG. 7 is a plan view of the plug connector as shown in FIG. 6.
FIG. 8 is a fragmentary view of a portion of a ground plate of the plug connector.
FIG. 9 is a view illustrating a modified ground plate for the plug connector.
FIG. 10 is a view illustrating another modified ground plate for the plug connector.

As shown in FIG. 7, the plug connector 12 has contacts 31, 32, 33 and 34 adapted to mate with the contacts 25, 26, 27 and 28, respectively. Contacts 31 and 32 are supported by the insulating member 21 on one side of the ground plate 18 while contacts 33 and 34 are supported by the insulating member 22 on the opposite side of the insulating member.

All contacts have the same spatial relationship to the associated grounded high conductively planar ground plate and shell surfaces so that all signal transmission paths have substantially the same characteristic impedance.

As best shown in FIG. 1, each of the contacts 25 has a hollow end portion **25*a* which projects from a surface 19*a* of the member 19 and which extends into an opening 21*a* in the member 21 to receive a projecting portion 31*a* of the contact 31, indicated in dotted lines. Each of the other contacts of connector 11 has a configuration like that of the contact 25 and each of the other contacts of connector 12 has a configuration like that of the contact 31. Thus in the illustrated arrangement, each contact 25 is a female contact and each contact 31** is a male contact but it will be understood that the contacts may be reversed and that, in any case, the invention is not limited to any particular form or relationship of the mating signal contacts.

Figure 4:
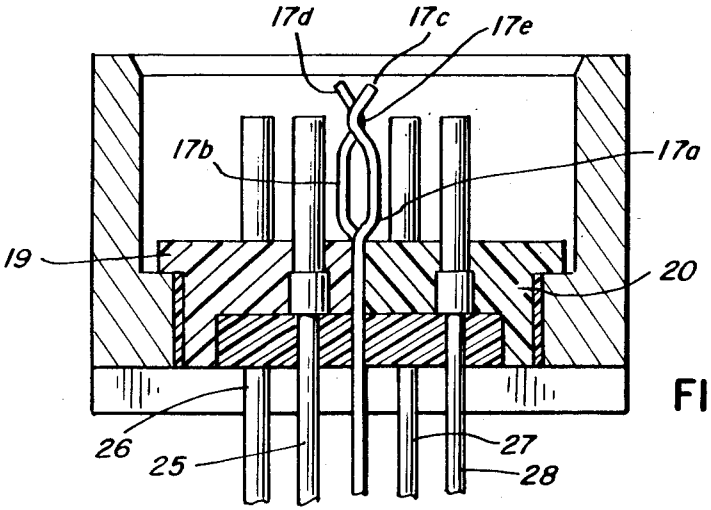
FIG. 4 is a sectional view of the receptacle connector, on a scale larger than that of FIG. 2 but smaller than that of FIG. 1, particularly showing the relationship of engagement fingers or tines of the connector.
Figure 5:
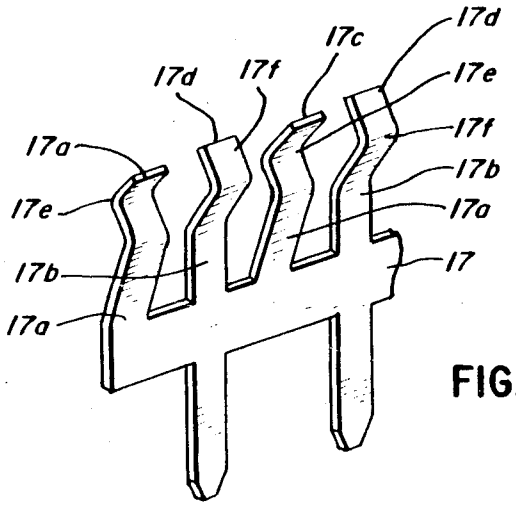
FIG. 5 is a fragmentary perspective view of a ground plate of the receptacle connector.

The construction of the ground plate 17 is illustrated in FIG. 5. It is preferably of a copper alloy which may be approximately 0.006 inches thick with a 0.00005 inch gold plate for maximum conductivity and it is formed with projecting fingers or tines **17*a* and 17*b* as shown, having terminal end portions 17*c* and 17*d* bent in opposite directions from a central plane of the plate 17 and having portions 17*e* and 17*f* for pressure engagement with an edge portion of the plate 18 when the connectors are assembled. The relationship of the tines 17*a* and 17*b* before assembly, is illustrated in FIG. 4. In assembly, the tines 17*a* and 17*b* move into recesses 22*b* and 21*b*, respectively, of the insulating members 22 and 21. In the normal mating sequence, the end of the shell 16 moves into the shell 15, then the edge of the plate 18 moves between the terminal ends 17*c* and 17*d* of the tines 17*a* and 17*b* and then the ends of the contacts 31–34 move into the sockets defined by the hollow ends of the contacts 25–28**. With this mating sequence, the ground connection is made before the signal connection and any electrostatic build-up is discharged before engagement of signal contacts. This protects electronic devices from damage during handling and repair.

The construction of the plate 18 is shown in FIGS. 1 and 8. It is preferably of a copper alloy which may be approximately 0.006 inches thick, with a 0.00005 inch gold plate for increased conductivity and, for connection to the circuit board assembly, it has one edge rolled to form an open generally tubular portion **18*a*. The portion 18*a* engages ground terminals which extend in facing relation on the surfaces 37 and 38 of two circuit boards 39 and 40 which form the circuit board assembly 14. In the illustrated arrangement, a thick metal plate 41 is disposed between the circuit boards 39 and 40 to form a heat sink. The circuit boards 39 and 40 are so formed as to provide terminals which engage extensions 31***a*, 32*a*, 33*a* and 34*a* of the contact elements 31, 32, 33 and 34, such extensions extending outwardly and then inwardly and then outwardly, as shown, to provide contact surfaces for contact with terminals on the outwardly facing sides of the circuit boards 39 and 40.

The extensions 31*a*, 32*a*, 33*a* and 34*a* and also the portion 18*a* of ground plate 18 may be tinned before assembly and soldered to the respective terminals after assembly, or other bonding operations may be performed, if desired.

FIG. 9 illustrates a modified ground plate 42 usable in place of the ground plate 18 and having a plurality of fingers or tines along its length, alternate tines 42*a* being bent outwardly in one direction and the remaining tines being bent outwardly in the opposite direction, for engagement with ground terminals of the printed circuit boards 39 and 40.

FIG. 10 shows a modified ground plate 44 which has tines 44*a* and 44*b* formed to engage ground terminals 45 and 46 on the outside surfaces of the printed wiring boards 39 and 40 of assembly 14.

Figure 11:
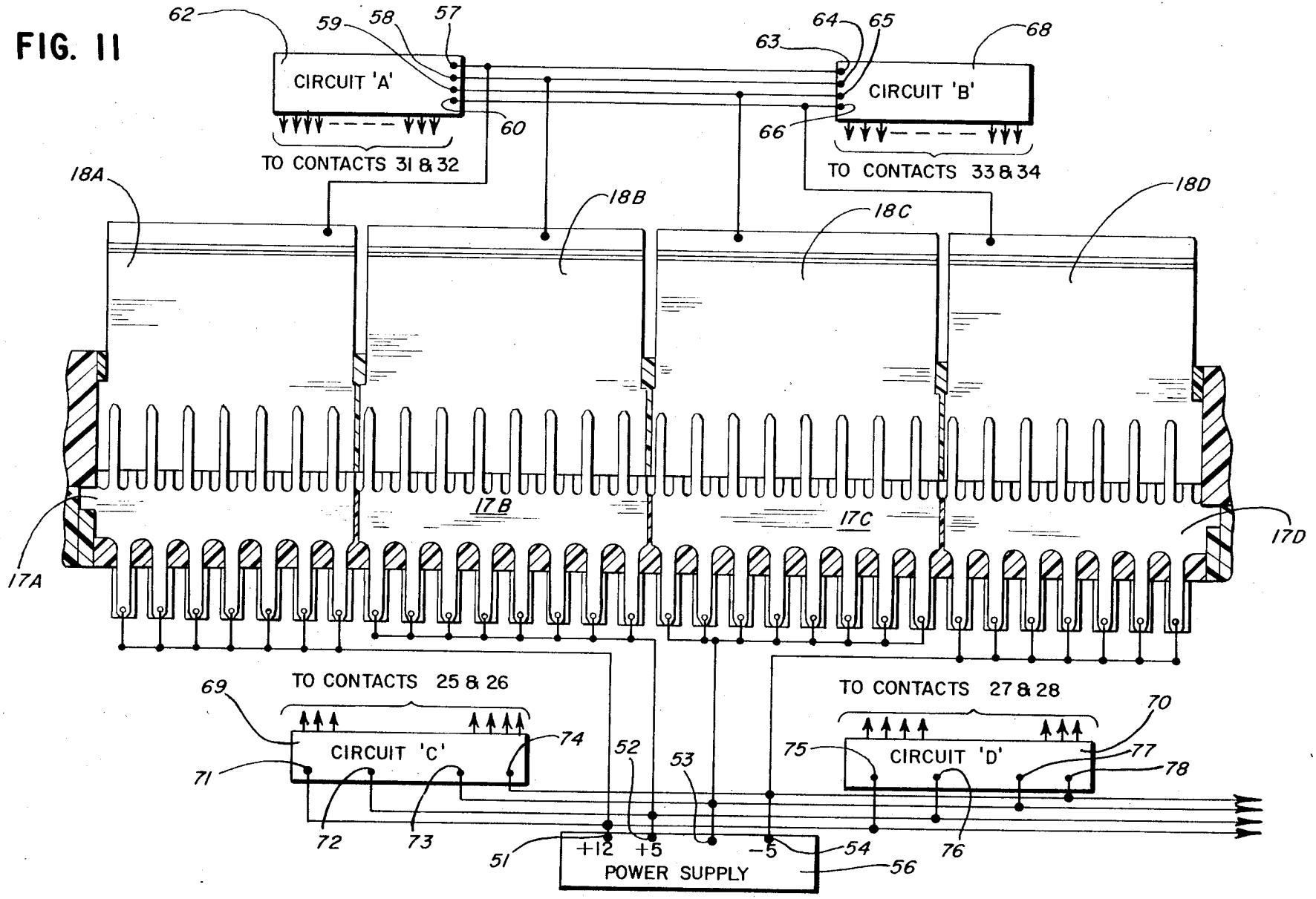
FIG. 11 is a cross sectional view taken substantially along line XI—XI of FIG. 1.

As shown in FIG. 11, the ground plate 17 of one section of the illustrated connector 11 is formed by four separate plate sections 17A, 17B, 17C and 17D which are in longitudinally spaced relation but with close spacings therebetween preferably less than the distance between contacts. The ground plate 18 of the corresponding section of the connector 12 is formed by four separate plate sections 18A, 18B, 18C and 18D also in longitudinally spaced relation but with close spacings therebetween. The AC impedances between the plate sections 17A–17D and between the plate sections 18A–18D is desirably very low so that at high frequencies, plate sections 17A–17D and plate sections 18A–18D effectively form one ground plate when connected. However, they are usable advantageously for transmission of supply, reference or control voltages.

For example, as diagrammatically illustrated in FIG. 11, plate sections 17A, 17B, 17C and 17D of the mother board connector 11 may be respectively connected to +12 volt, +5 volt, common and −5 volts, terminals 51, 52, 53 and 54 of a DC power supply 56 and plate sections 18A, 18B, 18C and 18D of the daughter board connector 12 may be respectively connected to power input terminals 57–60 of an "A" circuit 62 of the daughter board and power input terminals 63–66 of a "B" circuit 68 of the daughter board, the "A" and "B" circuits being on the circuit boards 39 and 40 of the illustrated embodiment and being connected to the signal contacts 31 and 32 on one side of the control ground plane and signal contacts 33 and 34 on the opposite side of the ground plane. As also shown, signal contacts 25 and 26 and signal contacts 27 and 28 of the mother board connector 11 may be connected to "C" and "D" signal circuits 69 and 70, respectively, circuits 69 and 70 having terminals 71–74 and terminals 75–78 connected to terminals 51–54 of power supply 56. It will be understood that the power supply 56 will provide low high frequency impedances to signal ground at terminals 51–54 and also that the "A" and "B" circuits 62 and 68 may include capacitors providing low high frequency impedances between signal ground and terminals 57–60 and terminals 63–66.

The plates of the second connector sections, on the other side of the intermediate wall portion 29, may be divided into separate plate sections like sections 17A–17D and 18A–18D, but it is noted that in some applications, two ground plates or two ground plates and a shell, as provided in embodiment disclosed in my prior application, may be all that is needed for voltage transmission.

It will be understood that the invention is not limited to use of the ground plates for transmission of DC supply voltages but such ground plates may be used for transmission of DC reference voltages and on-off control voltages. They may also be used for transmission of low frequency AC power supply, reference or control voltages and as many plates or plate sections may be provided as are desired or required for any particular application. Thus, it is not necessary to use contacts for such purposes and all contacts are available for use in propagating high frequency signals. Moreover, uniform impedance characteristics are obtained between all contact and the ground provided by the ground plates and outer shell.

It will be understood that the invention is not limited to use with a dual circuit arrangement as shown. It is advantageous in any application in which providing an adequate ground is a problem and is particularly advantageous in applications in which separation or isolation of circuits is desirable.

It will be understood that modifications and variations may be effected without departing from the spirit and scope of the novel concepts of this invention.

I claim:

1. An electrical connector assembly including a pair of mating connectors and arranged for high velocity propagation of electrical signals along a plurality of paths between first circuit means connected to one connector and second circuit means connected to the other connector, each connector comprising: a plurality of signal contact elements for propagation of said signals, each having connection means at one end thereof for connection to a terminal of said first circuit or second circuit means and having a contact surface at an opposite end thereof for engagement with a contact surface of a contact element of the mating connector, common ground means for all of said contact elements including a plurality of ground plates each having connector means along one edge thereof for connection to a terminal of said first circuit means and having contact surface means along an opposite edge thereof for engagement with contact surface means of a ground plate of a mating connector, said contact surface means of one connector being in the form of multi-spring-fingered contact surface means along said opposite edge thereof for engagement with a pair of oppositely disposed contact surface means of a continuous ground plate of the mating connector, and support means for supporting all of said signal contact elements in a certain fixed and electrically insulated relation to each other and to said common ground means such as to obtain a uniform characteristic impedance along all signal paths through said mating connectors, said signal contact elements including a plurality of groups of elements, each group being associated with one of said ground plates and each being supported in at least one row in longitudinally spaced parallel relation to said associated ground plate.

2. An electrical connector assembly as defined in claim 1 wherein said plurality of ground plates are usable for supply of voltages between said first and second circuit means while providing a common AC ground with respect to said high velocity propagation of electrical signals along said plurality of paths.

3. An electrical connector assembly as defined in claim 2 wherein said plurality of ground plates are in generally coplanar and longitudinally spaced relation.

4. An electrical connector assembly as defined in claim 3 wherein the longitudinal spacing between contact elements of all rows is uniform and wherein the longitudinal spacing between adjacent ground plates is less than the longitudinal spacing between contact elements.

5. An electrical connector assembly as defined in claim 1 wherein said contact elements associated with each ground plate include a second group of elements supported in a second row parallel to the first row and to the associated ground plate.

6. An electrical connector assembly as defined in claim 5 wherein said first and second groups of elements are on the same side of said associated ground plate.

7. An electrical connector assembly as defined in claim 1 wherein each of said first and second circuit means includes AC ground terminal means and a plurality of ungrounded terminals, said connection means of said ground plates of said connectors being arranged for connection to said ground terminals of said first and second circuit means and said connection means of said contact elements being arranged for connection to said ungrounded terminals of said first and second circuit means.

8. An electrical connector assembly as defined in claim 1 wherein said ground plates are effective to provide a very highly conductive path for high frequency current components to prevent loss of reference voltage between said first and second circuit means.

9. An electrical connector assembly including a pair of mating connectors and arranged for high velocity propagation of electrical signals along a plurality of paths between first circuit means connected to one connector and second circuit means connected to the other connector, each connector comprising: a plurality of signal contact elements for propagation of said signals, each having connection means at one end thereof for connection to a terminal of said first circuit or second circuit means and having a contact surface at an opposite end thereof for engagement with a contact surface of a contact element of the mating connector, a plurality of ground plates each having connector means along one edge thereof for connection to a terminal of said first circuit means and having contact surface means along an opposite edge thereof for engagement with contact surface means of a ground plate of a mating connector, and support means for supporting signal contact elements in fixed and electrically insulated relation to each other and to said ground plates, said signal contact elements including a plurality of groups of elements, each group being associated with one of said ground plates and each being supported in at least one row in longitudinally spaced parallel relation to said associated ground plate wherein said contact elements associated with each ground plate include a second group of elements supported in a second row parallel to the first row and to the associated ground plate and wherein said first and second groups of elements are on opposite sides of said associated ground plate.

10. An electrical connector assembly including a pair of mating connectors and arranged for high velocity propagation of electrical signals along a plurality of paths between first circuit means connected to one connector and second circuit means connected to the other connector, each connector comprising: a plurality of signal contact elements for propagation of said signals, each having connection means at one end thereof for connection to a terminal of said first circuit or second circuit means and having a contact surface at an opposite end thereof for engagement with a contact surface of a contact element of the mating connector, common ground means for all of said contact elements including a plurality of ground plates each having connector means along one edge thereof for connection to a terminal of said first circuit means and having contact surface means along an opposite edge thereof for engagement with contact surface means of a ground plate of a mating connector, and support means for supporting all of said signal contact elements in a certain fixed and electrically insulated relation to each other and to said common ground means such as obtain a uniform characteristic impedance along all signal paths through said mating connectors, said signal contact elements including a plurality of groups of elements, each group being associated with one of said ground plates and each being supported in at least one row in longitudinally spaced parallel relation to said associated ground plate, wherein said support means includes an outer shell of conductive material in generally surrounding relation to said contact elements and said ground plates, and means including insulator means within said shell for support of said contact elements and said ground plates, said contact elements being so positioned in relation to said ground plates and said outer shell as to obtain a substantially constant characteristic impedance with respect to all of said contact elements.

11. An electrical connector assembly as defined in claim 10, wherein said plurality of ground plates are usable for supply of voltages between said first and second circuit means while providing a common AC ground with respect to said high velocity propagation of electrical signals along said plurality of paths.

12. An electrical connector assembly including a pair of mating connectors and arranged for high velocity propagation of electrical signals along a plurality of paths between first circuit means connected to one connector and second circuit means connected to the other connector, each connector comprising: a plurality of signal contact elements for propagation of said signals, each having connection means at one end thereof for connection to a terminal of said first circuit or second circuit means and having a contact surface at an opposite end thereof for engagement with a contact surface of a contact element of the mating connector, a plurality of ground plates each having connector means along one edge thereof for connection to a terminal of said first circuit means and having contact surface means along an opposite edge thereof for engagement with contact surface means of a ground plate of a mating connector, and support means for supporting signal contact elements in fixed and electrically insulated relation to each other and to said ground plates, said signal contact elements including a plurality of groups of elements, each group being associated with one of said ground plates and each being supported in at least one row in longitudinally spaced parallel relation to said associated ground plate, wherein each of said first and second circuit means includes AC ground terminal means and a plurality of ungrounded terminals, said connection means of said ground plates of said connectors being arranged for connection to said ground terminals of said first and second circuit means and said connection means of said contact elements being arranged for connection to said unground terminals of said first and second circuit means, and wherein said ground plate is between certain of said contact elements and the elements connected to said ungrounded terminals of said circuit portions to provide electrical separation and isolation thereof.

13. An electrical connector assembly as defined in claim 12 wherein at least one of said first and second circuit means includes a plurality of portions, each having AC ground terminal means and ungrounded terminals, said connection means of said ground plates being connected with said ground terminal means of all of said circuit portions and said connection means of said contact elements being connected to ungrounded terminals of said plurality of circuit portions.

14. An electrical connector assembly including a pair of mating connectors and arranged for high velocity propagation of electrical signals along a plurality of paths between first circuit means connected to one connector and second circuit means connected to the other connector, each connector comprising: a plurality of signal contact elements for propagation of said signals, each having connection means at one end thereof for connection to a terminal of said first circuit or second circuit means and having a contact surface at an opposite end thereof for engagement with a contact surface of a contact element of the mating connector, common ground means for all of said contact elements including a plurality of ground plates each having connector means along one edge thereof for connection to a terminal of said first circuit means and having contact surface means along an opposite edge thereof for engagement with contact surface means of a ground plate of a mating connector, and support means for supporting all of said signal contact elements in a certain fixed and electrically insulated relation to each other and to said common ground means such as to obtain a uniform characteristic impedance along all signal paths through said mating connectors, said signal contact elements including a plurality of groups of elements, each group being associated with one of said ground plates and each being supported in at least one row in longitudinally spaced parallel relation to said associated ground plate, wherein said contact elements associated with each ground plate include a second ground of elements supported in a second row parallel to the first row and the associated ground plate and wherein said first and second groups of elements are on the same side of said associated ground plate and wherein said contact elements associated with each ground plate include third and fourth groups of elements supported in third and fourth rows on a side of said associated ground plate opposite said first and second groups, said support means including an outer shell of conductive material in generally surrounding relation to said contact elements and said ground plates, and means including insulator means within said shell for support of said contact elements and said ground plates.

15. An electrical connector assembly as defined in claim 14 wherein said first and second rows and said third and fourth rows are respectively located centrally between said associated ground plate and said shell to obtain substantially uniform impedance for minimizing reflections, standing waves and cross-talk.

16. An electrical connector assembly as defined in claim 15 wherein the spacings between each of said rows to the adjacent ground plate or shell surface is a small fraction of the length of the conducting path to minimize electromagnetic interference.

* * * * *